US006547216B1

(12) United States Patent
Bouchard et al.

(10) Patent No.: US 6,547,216 B1
(45) Date of Patent: Apr. 15, 2003

(54) MULTIPLE BALLS SUPPORTED PUSH ACTUATOR

(75) Inventors: Paul-André Bouchard, Outremont (CA); Pierre Laforest, Montreal (CA); Pierre Gagnon, Montreal (CA); Alain Forté, Boucherville (CA)

(73) Assignee: Gestion LaForest Inc., St-Hubert (CA)

( * ) Notice: Subject to any disclaimer, the term of this patent is extended or adjusted under 35 U.S.C. 154(b) by 0 days.

(21) Appl. No.: 09/958,287

(22) PCT Filed: Apr. 12, 2000

(86) PCT No.: PCT/CA00/00404

§ 371 (c)(1),
(2), (4) Date: Oct. 9, 2001

(87) PCT Pub. No.: WO00/63106

PCT Pub. Date: Oct. 26, 2000

Related U.S. Application Data

(60) Provisional application No. 60/129,631, filed on Apr. 16, 1999.

(51) Int. Cl.[7] ..... B66F 3/00

(52) U.S. Cl. ..... 254/1; 254/89 R; 254/98

(58) Field of Search ..... 254/1, 89 R, 98, 254/DIG. 6; 74/501 R; 52/10, 108

(56) References Cited

U.S. PATENT DOCUMENTS

| | | | | |
|---|---|---|---|---|
| 1,570,429 A | | 1/1926 | Bonnet | |
| 2,130,993 A | | 9/1938 | Dubilier | |
| 2,173,685 A | | 9/1939 | Grassmann | |
| 2,265,892 A | | 12/1941 | Bloch | |
| 2,269,363 A | | 1/1942 | Farrand | |
| 2,574,657 A | | 11/1951 | Pierce | |
| 2,946,556 A | | 7/1960 | Edgerton | |
| 3,016,988 A | | 1/1962 | Browning | |
| 4,875,660 A | | 10/1989 | Gagnon et al. | |
| 5,056,278 A | * | 10/1991 | Atsukawa | 254/95 |
| 6,224,037 B1 | * | 5/2001 | Novick | 254/95 |
| 6,428,419 B1 | * | 8/2002 | Sheldon | 472/60 |

FOREIGN PATENT DOCUMENTS

| | | |
|---|---|---|
| CA | 391718 | 3/1932 |
| DE | 241789 | 12/1911 |
| DE | 1225839 | 12/1911 |
| DE | 547836 | 9/1966 |
| GB | 1331910 | 9/1973 |

* cited by examiner

*Primary Examiner*—Joseph J. Hail, III
*Assistant Examiner*—Daniel Shanley
(74) *Attorney, Agent, or Firm*—Francois Martineau

(57) ABSTRACT

The push actuator has a fixed base which rotatably carries a selectively rotatable rotor. A horizontal band has a lower portion stacked in a helical pattern and has an upper portion engaged by the upper portion of a vertical band, to form a telescopic column. The lower portion of the vertical band is stacked in a spiral, separately from the horizontal band, the horizontal band is supported on the rotor with a helical ball support track along which a number of balls can roll and slide, to allow substantially frictionless rotation of the rotor member while the horizontal band remains rotatably stationary. A ball re-circulation unit allows the balls to circulate between the top of the track and the bottom of the track. Upon rotation of the rotor, the vertical column is formed by the horizontal band being lifted and its turns being spaced through its engagement on the rotating helical ball support track, and by each turn of the vertical band being inserted between two vertically successive turns of the horizontal band.

16 Claims, 5 Drawing Sheets

MULTIPLE BALLS SUPPORTED PUSH ACTUATOR

This application claims the benefit of Prov. Appl. Ser. No. 60/129,631 filed Apr. 16, 1999.

FIELD OF THE INVENTION

The present invention relates to a push actuator, and more particularly to a push actuator having a telescopic column formed with a pair of inter-spaced helical bands, one of which being supported with a ball support member.

BACKGROUND OF THE INVENTION

U.S. Pat. No. 4,875,660 issued in 1989 to two of the co-inventors of the present invention, Pierre Gagnon and Pierre Laforest (hereafter the Gagnon patent), shows a push actuator to be used instead of a hydraulic cylinder. The Gagnon push actuator has the advantage of requiring less space than conventional hydraulic cylinders when in a contracted position, due to the fact that no concentric tube portions have to be stored within each other. Also, it can support a very heavy load, since it forms a cylindrical column when in an extracted position, without any concentric portions as with a hydraulic cylinder, and this vertical structure has a high vertical rigidity. Very important worldwide commercial success of the push actuator of the above-mentioned Gagnon patent has proven it to be a very advantageous alternative to conventional hydraulic cylinders.

The Gagnon push actuator generally works as follows. A hollow cylindrical rotor is rotatably carried over a base fixed to the ground. A motor selectively activates the rotor. A first horizontal band is vertically stacked in a helix and rests on the ground, while a second vertical band is horizontally stacked in a spiral, the latter located in an annular casing located co-axially around the rotor. The upper end of each band is fixedly attached to a platform, which is destined to be raised. When the rotor is rotated, each turn of the vertical band is guided and installed between two vertically successive turns of the horizontal band, to thus gradually form a vertical telescopic column. The load of the platform supported by the push actuator is induced through the vertical and horizontal band turns, to the idle rollers which support the horizontal band for one full helical turn.

One problem associated with the Gagnon push actuator resides in the load-bearing rollers used to support the horizontal band and the loaded platform. The rollers are indeed a very expensive component of the push actuator, and require significant space inside the rotor, which results in a diametrally larger push actuator.

OBJECTS OF THE INVENTION

It is the general object of the present invention to provide a push actuator capable of forming a telescopic column, which improves upon the prior art Gagnon push actuator.

It is another object of the present invention to provide a push actuator which has enhanced load-bearing elements to replace the cumbersome and expensive prior art rollers.

SUMMARY OF THE INVENTION

The present invention relates to a telescopic tube comprising:

a first annular band wound in helical form about a central axis with its turns transversely normal to said central axis and capable of taking a retracted stacked position with its turns resting flat against one another, and an extended position with its turns spaced from one another in the direction of said central axis;

a second band wound on itself, with its turns transversely parallel to said central axis and capable of taking a retracted, spiral position with its turns nested within one another and an extended position with its turns forming a helix around said central axis and generally equally radially spaced therefrom to form a tube, said first and second bands, when in retracted position, being in respective locations so as to clear each other;

a frame having a base resting on the ground and a rotor rotatably carried by said base;

a continuous frictionless support member carried by said rotor and forming at least a portion of a helix for supporting part of said first band, and for successively spacing the turns of said first band;

a power device, to cause relative rotation of said first band and of said rotor about said central axis, said continuous frictionless support member allowing the axially oriented load of said push actuator to be transmitted from said first band to said rotor while allowing a substantially frictionless relative rotation of said first band and said rotor; and a guiding member to insert the turns of the second band between the spaced turns of the first band, with the edges of the turns of the second band bearing against the turns of the first band, the second band thus forming a spacer for the turns of the first band.

Preferably, said continuous frictionless support member includes a number of balls carried on a track carried by said rotor and forming at least a portion of a helix for supporting part of said first band, and for successively spacing the turns of said first band.

Preferably, said track has a first and a second ends, said continuous frictionless support member further comprising a ball re-circulation unit including at least one channel linking said track first and second ends for allowing said balls to engage said channel and consequently to circulate between said track first and second ends.

The present invention further relates to a push actuator having opposite first and second ends and an intermediate portion between said first and second ends, said push actuator further defining a central axis extending between said first and second ends and comprising:

a fixed base portion at said first end;

a rotor member rotatably carried by said base portion and rotatable about said central axis;

a power device, for selectively rotating said rotor member relative to said base portion;

a load-bearing member at said second end, movable relative to said first end, between a retracted position in which said load-bearing member is adjacent to said first end, and an extracted position in which said load-bearing member is distally located relative to said first end;

a first flat band being perpendicular to said central axis, being wound according to a helical pattern about said central axis, and having a first end portion adjacent said push actuator first end and a second end portion attached to said load-bearing member;

a second flat band being parallel to said central axis, being wound according to a helical pattern about said central axis, and having a first end portion adjacent said push actuator first end and a second end portion attached to said load-bearing member;

a continuous frictionless support member with at least a portion thereof being wound in a helical pattern about said central axis, with part of said first helical band engaging said continuous frictionless support member allowing substantially frictionless rotation of said rotor member relative to said first band; and a guiding member at said push actuator intermediate portion and carried by said rotor member, for guiding said second band so as to place each turn of each one of said first and second bands between two successive turns of the other one of said first and second bands between said intermediate portion and said second end when said rotor member is rotated in a first direction around said central axis, thus forming a telescopic column composed of the interconnected first and second bands with the edges of the turns of the second band bearing against the turns of the first band, and with said first and said second bands each being independently stackable between said intermediate portion and said first end.

Preferably, said continuous frictionless support member forms a closed loop around said central axis and includes:

a track carried by said rotor member, wound in a helical pattern and having a first and a second ends;

a re-circulating unit including at least one inner channel linking said track first and second ends; and a support medium capable of circulating along said track and through said re-circulating unit channel between said track first and second ends, with part of said first helical band engaging said continuous frictionless support member by bearing against said support medium for allowing substantially frictionless rotation of said rotor member relative to said first band.

Preferably, said continuous frictionless support member is a ball support member and said support medium is a number of balls engaging said track, with at least part of said first helical band engaging said balls for allowing substantially frictionless rotation of said rotor member relative to said first band.

Preferably, the portion of said first band which is located between said first end and said intermediate portion of said push actuator is stacked in a helical pattern, and the portion of said second band which is located between said first end and said intermediate portion of said push actuator is stacked in a spiral pattern.

Preferably, said portion of said second band which is stacked in a spiral pattern is stored in a second band magazine which is rotatably carried by either one of said base portion and said rotor member.

Preferably, said track of said ball support member forms n complete helical turns, with n being a positive integer.

Preferably, said track of said ball support member forms a single complete helical turn.

Preferably, said push actuator base portion includes a ground-bearing structure supporting a casing through the instrumentality of a universal joint allowing pivotal displacement of said casing relative to said ground-bearing structure, with said rotor member being rotatably carried by said casing.

Preferably, said push actuator is destined to be used with its central axis being vertically aligned and with said first end being located under said second end, said load-bearing member being a platform member including a top platform and a lower saucer linked to each other by means of a universal joint for allowing pivotal displacement of said top platform relative to said lower saucer, with said second ends of said first and second bands being attached to said saucer.

Preferably, said push actuator is destined to be used with its central axis being vertically aligned and with said first end being located under said second end, said track being supported by said rotor by means of a spring member fixedly carried by said rotor.

Preferably, said spring member is a leaf spring formed in a helical pattern and continuously supporting said track.

Preferably, said ball support track comprises two helical ball channels wherein two adjacent rows of balls are provided.

The present invention further relates to a push actuator having a vertical central axis, comprising:

a fixed base;

a selectively rotatable rotor carried by said base;

a power device for selectively rotating said rotor about said central axis;

a horizontal helical band having a lower portion stacked in a helical pattern and a helical upper portion;

a vertical band, having a lower portion stacked in a spiral pattern separately from said horizontal band, and an upper helical portion engaged by the upper portion of said horizontal band to form a vertical telescopic column;

a helical ball support track member carried by said rotor and including a helical track along which a number of balls can roll and slide, said track having an upper and a lower end, said horizontal band resting on said balls to allow rotation of the rotor member while the horizontal band remains rotatably stationary;

a ball re-circulation unit linking said track upper and lower ends and including ball channels engageable by said balls to allow said balls to circulate between said track upper and lower ends; and a guiding member mounted to said rotor;

wherein upon rotation of said rotor, said vertical column is formed with the upper portions of said horizontal and vertical bands, by said horizontal band being lifted and its turns being spaced through its engagement on the rotating helical ball support track member, and by each turn of said vertical band being guided by guiding member to be inserted between two vertically successive turns of said horizontal band, with the edges of said vertical band bearing against said horizontal band.

DETAILED DESCRIPTION OF THE EMBODIMENTS

Figure 1:
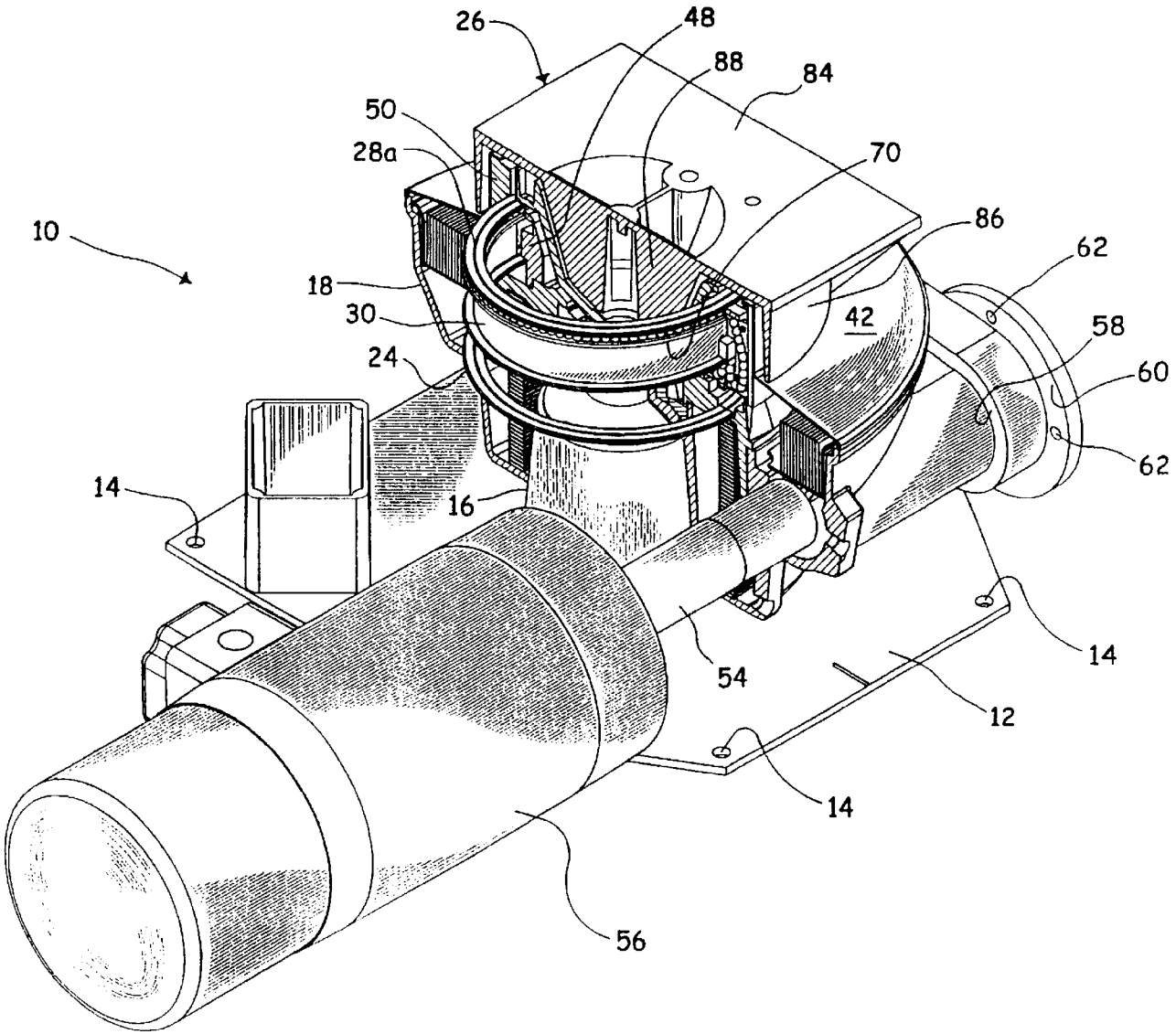
FIG. 1 is a perspective view of the push actuator according to the invention in its retracted position, with one half of the outer casing thereof and of the load-bearing platform thereof being removed, to show the inner parts of the push actuator.
Figure 2:
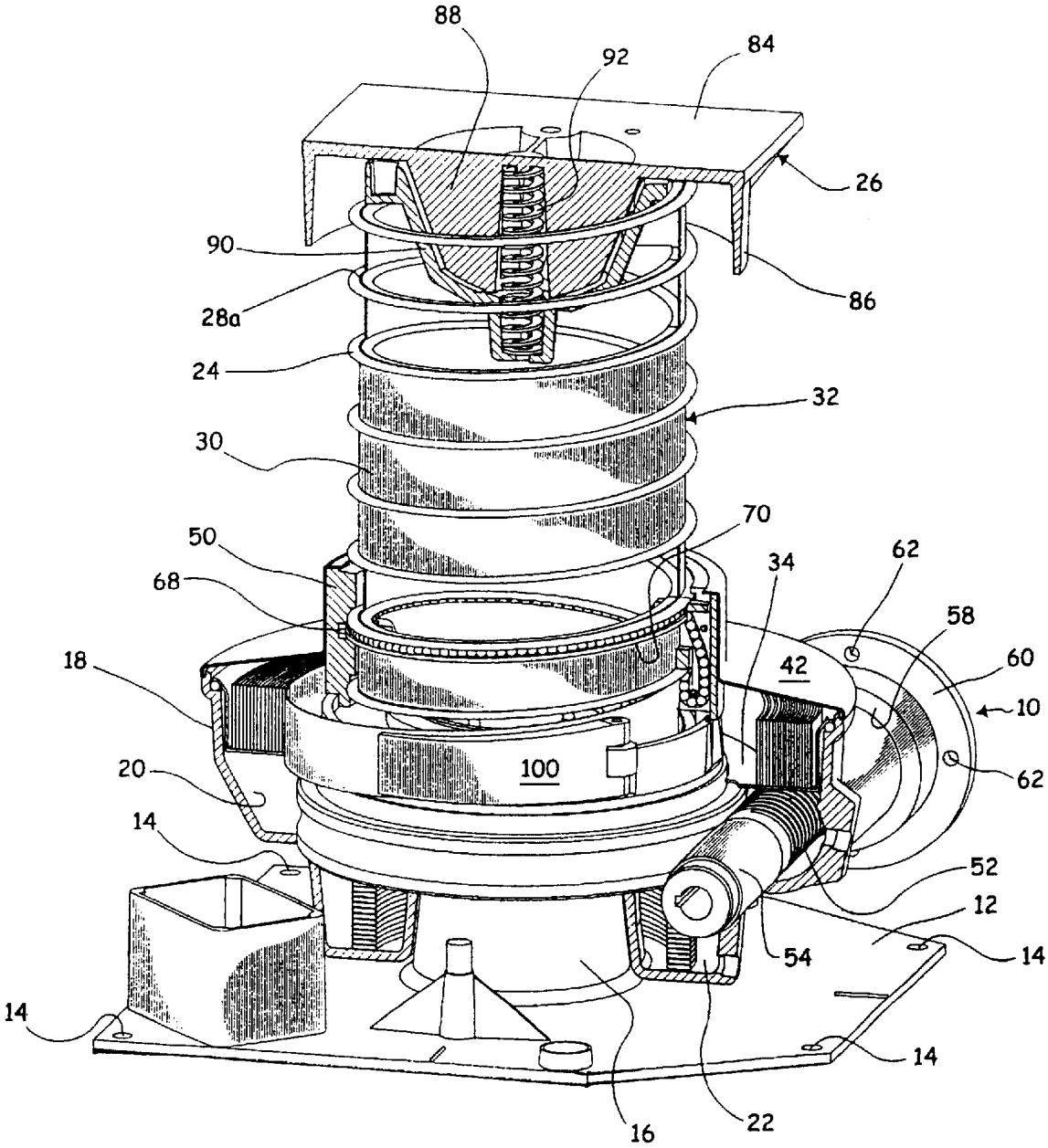
FIG. 2 is a view similar to FIG. 1, although at a slightly different angle, with the push actuator being shown in a partly extracted position, with the motor being removed and with the guide arm for the vertical band being shown.
Figure 3:
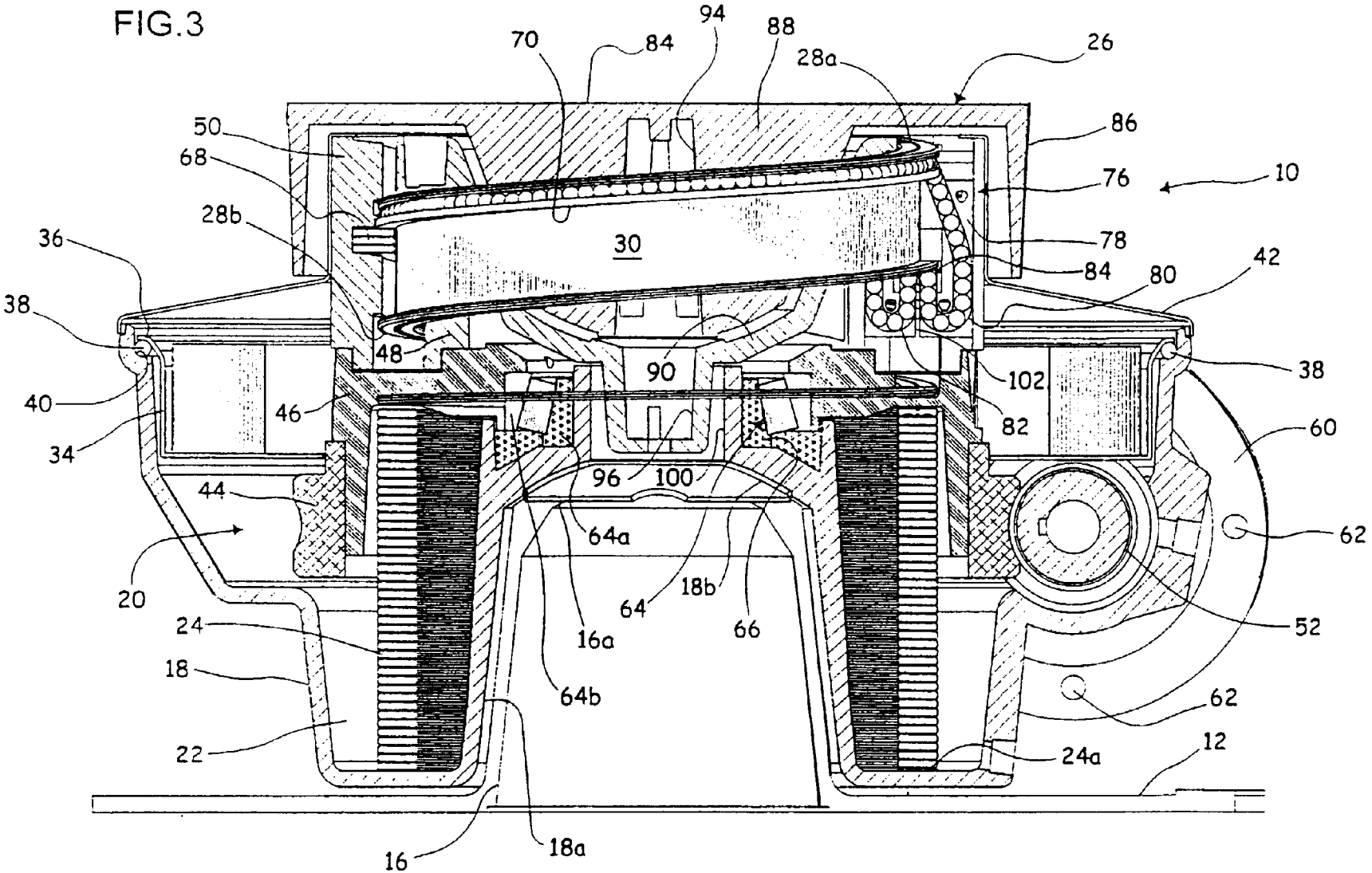
FIG. 3 is a cross-sectional elevation of the push actuator of FIG. 1, at an enlarged scale.

FIGS. 1–3 show a push actuator 10 according to the present invention. Push actuator 10 works in a similar way than the one shown in the above-mentioned Gagnon patent, except that it comprises several advantages thereover, one of which is the load-bearing ball support member which advantageously replaces the rollers. This and other advantages of the push actuator according to the present invention will be more readily appreciated from the following description.

Push actuator 10 comprises a base plate 12 bored at 14 for fixed attachment to the ground. Base plate 12 fixedly supports a frusto-conical hub 16 which engages a complementary generally frusto-conical depression 18*a* in the casing 18 of the push actuator 10. As suggested in FIG. 3, the upper portion 16*a* of hub 16 is partly spherical and concave, and the upper end portion 18*b* of the casing depression 18*a* is partly spherical and convex, for forming a universal joint by the resting abutment of the casing spherical end portion 18*b* onto the hub spherical upper portion 16*a*. It can be seen that the lateral sides of hub 16 clear the inner walls of depression 18*a*, to allow a slight pivotal displacement of casing 18 on hub 16. When the push actuator 10 is loaded, reduced structural stresses will be induced to push actuator 10 due to the presence of the universal joint 16*a*, 18*b* which allows this pivotal displacement, to compensate slight misalignments, e.g. if the load is not directed in a precise vertical fashion against push actuator 10. Apart from this slight pivotal displacement allowing for slight misalignment compensation, casing 18 remains stationary, i.e. it does not rotate about a central vertical axis of push actuator 10.

Casing 18 is hollow, and defines a substantially annular inner chamber 20. The lowermost portion of chamber 20 serves as a horizontal band magazine 22, where a flat horizontal band 24 is stacked in a helical configuration. Band 24 is said to be horizontal, since its flat turns are perpendicular to the vertical central axis of push actuator 10. Horizontal band 24 has a first trailing end 24*a* which rests in the bottom of casing 18, or which alternately can be attached thereto, and a second leading end (concealed in the drawings) which is attached to an upper load-bearing platform member 26, which will be described in more details hereinafter.

As known from the prior art Gagnon patent, the horizontal band 24 comprises upper and lower central grooves 28*a* and 28*b* on its upper and lower surfaces respectively, engageable by a flat vertical band 30 to form a telescopic column 32 (FIG. 2), as will be described hereinafter. Band 30 is said to be vertical since its flat turns are parallel to the vertical central axis of the push actuator. Vertical band 30 is stored in an annular vertical band magazine 34 having radially out-turned outer peripheral edge portions 36. Magazine 34 is rotatably carried by casing 18 by means of a number of balls 38 being peripherally located between the magazine edge portion 36 and an annular shoulder 40 in casing 18. A removable annular cover 42 is installed on casing 18 to allow access into magazine 34. It can be seen that vertical band 30 is stored in a spiral configuration, to be gradually fed to column 32 and to form a helix, with two successive turns of vertical band 30 being spaced by a turn of horizontal band 24, and vice-versa. Vertical band 30 has a first trailing end (concealed in the drawings) located inside vertical band magazine 34, and a second leading end (concealed in the drawings) fixedly attached to the underface of load-bearing support platform 26.

A rotor member is rotatably carried by the casing 18. The rotor member comprises the following integrally attached elements: an annular outwardly threaded crown member 44, an annular rotor 46, an annular inner drum 48 and an annular outer drum 50. All these integrally linked elements forming the rotor member can be selectively driven in rotation by an endless screw 52 threadingly engaging crown 44, screw 52 being provided on the shaft 54 of a motor 56. Shaft 54 extends on its end 58 opposite motor 56 to an attachment flange 60 which is bored at 62. Flange 60 can either be used as an alternate position for motor 56, or to be coupled with another rotating shaft for connection to another push actuator serially connected with the first one, for rotating both push actuators simultaneously through a single power device such as motor 56. The engagement of screw 52 to crown 44 allows the slight pivotal displacement of casing 18 on the hub 16.

The rotation of the rotor member is allowed by means of an annular roller bearing 64 located intermediate rotor 46 and an inner annular shoulder 66 of casing 18. Roller bearing 64 is slightly upwardly radially inwardly inclined. The lower housing 64*a* of roller bearing 64 is fixed to casing 18, while the upper housing of roller bearing 64 is fixed to the rotor 46.

Figure 4:
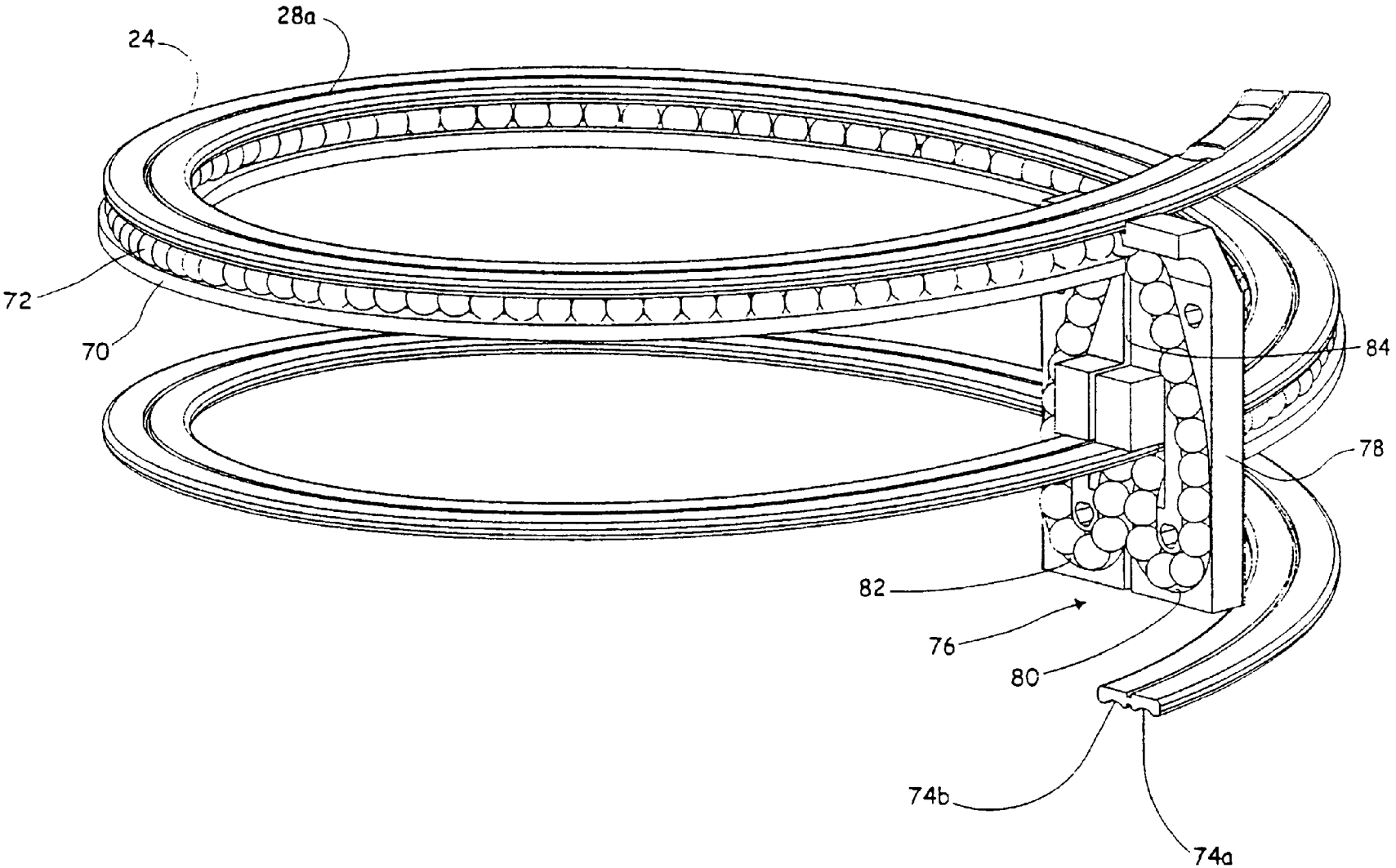
FIG. 4 is an enlarged perspective view of the load-bearing ball support member according to the invention, with a portion of the horizontal band forming the telescopic vertical column being shown.

Inner and outer drums 48, 50 are radially spaced from each other and are peripherally grooved in facing register with each other, to fixedly support a pair of leaf springs 68 (with the inner leaf spring being concealed in the drawings) which form one complete turn of a helix, having a pitch sized to correspond with the pitch of column 32. Leaf springs 68 are radially slightly spaced from each other, to allow the passage of vertical band 30 therebetween. Leaf springs 68 fixedly support a track 70 having an inner and an outer peripheral grooves on its upper surface, for supporting two rows comprising a number of balls 72 which slidingly and rollably engage track 70 (the grooves in track 70 being concealed by balls 72 in the drawings). In turn, the balls 72 support one full turn of horizontal band 24, the latter also having outer and inner rounded grooves 74*a*, 74*b* on its lower surface (FIG. 4) to guide balls 72 therein. Band 24 rests on balls 72 to allow relative rotational displacement of the rotor member 44, 46, 48, 50 and of band 24.

The inner and outer drums 48, 50 are annular in shape, although they are interrupted peripherally by the presence of a ball re-circulation casing unit 76 fixedly attached between the end portions of drums 48, 50. Unit 76 has the form of a casing 78, with only half of this casing being shown in the drawings, the other half being removed to allow the interior of unit 76 to be seen. Casing 78 has a J-shaped channel and an inverted J-shaped channel therein, respectively referenced as 80 and 82, sized for sliding and rolling engagement therein of balls 72. Furthermore, casing 78 has a cross-shaped slot 84 at its intermediate portion, to allow the sliding engagement therein of horizontal and vertical bands 24, 30. Slot 84 indeed allows one turn of horizontal band 24 to pass through re-circulating unit 76, while allowing one turn of vertical band 30 to pass thereover and one turn of vertical band 30 to pass thereunder.

Load-bearing platform 26 has an upper flat surface 84, and a skirt 86 which radially clears outer drum 50 when platform 26 is in its lower limit position (FIGS. 1 and 3). Platform 26 further has a central downwardly-projecting partly spherical convex hub 88 integral to the upper surface 84 and which engages a complementary partly spherical concave saucer 90 with a slight play being present between saucer 90 and hub 88. A coil spring 92 continuously biases hub 88 and saucer 90 away from each other. Spring 92 extends in central cylindrical housings 94 and 96 respectively provided in hub 88 and saucer 90, and which are in facing register and coaxial to each other. The spaced-apart spherical hub 88 and saucer 90 allow for a universal joint to be formed at the platform 26, to help compensate slight misalignments of a load on push actuator 10, by reducing the stresses induced in the push actuator structure by allowing the slight pivotal displacement of hub 88 relative to saucer 90. It can be seen in FIG. 3 that saucer 90, because of housing 96, downwardly protrudes into a chimney 98 formed in casing 18.

FIG. 2 shows that a spring-loaded guide arm 100 guides vertical band 30 into a proper alignment between two successive turns of horizontal band 24 while column 32 is being formed. Arm 100 is pivotally mounted to rotor 46, and is continuously biased radially inwardly.

In use, push actuator is initially in a completely retracted position shown in FIGS. 1 and 3. Upon selective activation of motor 56, endless screw 52 can rotate the rotor member 44, 46, 48, 50 about the vertical central axis of push actuator 10, including track 70 which is carried by inner and outer drums 48, 50. As the rotor member rotates, horizontal band 24 engages a slot (not shown) having a helical shape through rotor 46, then the slot 84 in the re-circulating unit 78 and finally the balls 72 supported by the helical track 70, to be gradually lifted and its turns spaced from each other, while however never rotating. Balls 72 allow for the rotor member to rotate while band 24 does not rotate. Meanwhile, the vertical band 30 is engaged by guide arm 100 between two successive turns of horizontal band 24, under re-circulating unit 78 and even partly cross-shaped slot 84, at 102 in FIG. 3. An opening (not shown, but similar to the one described in the Gagnon patent) in outer drum 50 allows vertical band 30 to be guided between outer drum 50 and inner drum 48, through slot 84 in re-circulating unit 76, and with each turn of vertical band 30 gradually being inserted between two successive turns of horizontal band 24. Vertical band 30 does not rotate once it becomes part of column 32, while each turn is gradually lifted by the underlying horizontal band 24 which is lifted by the rotating track 70 of the rotor member. Thus, load-bearing platform 26 does not rotate, since both its supporting bands 24, 30 do not rotate.

Figure 5:
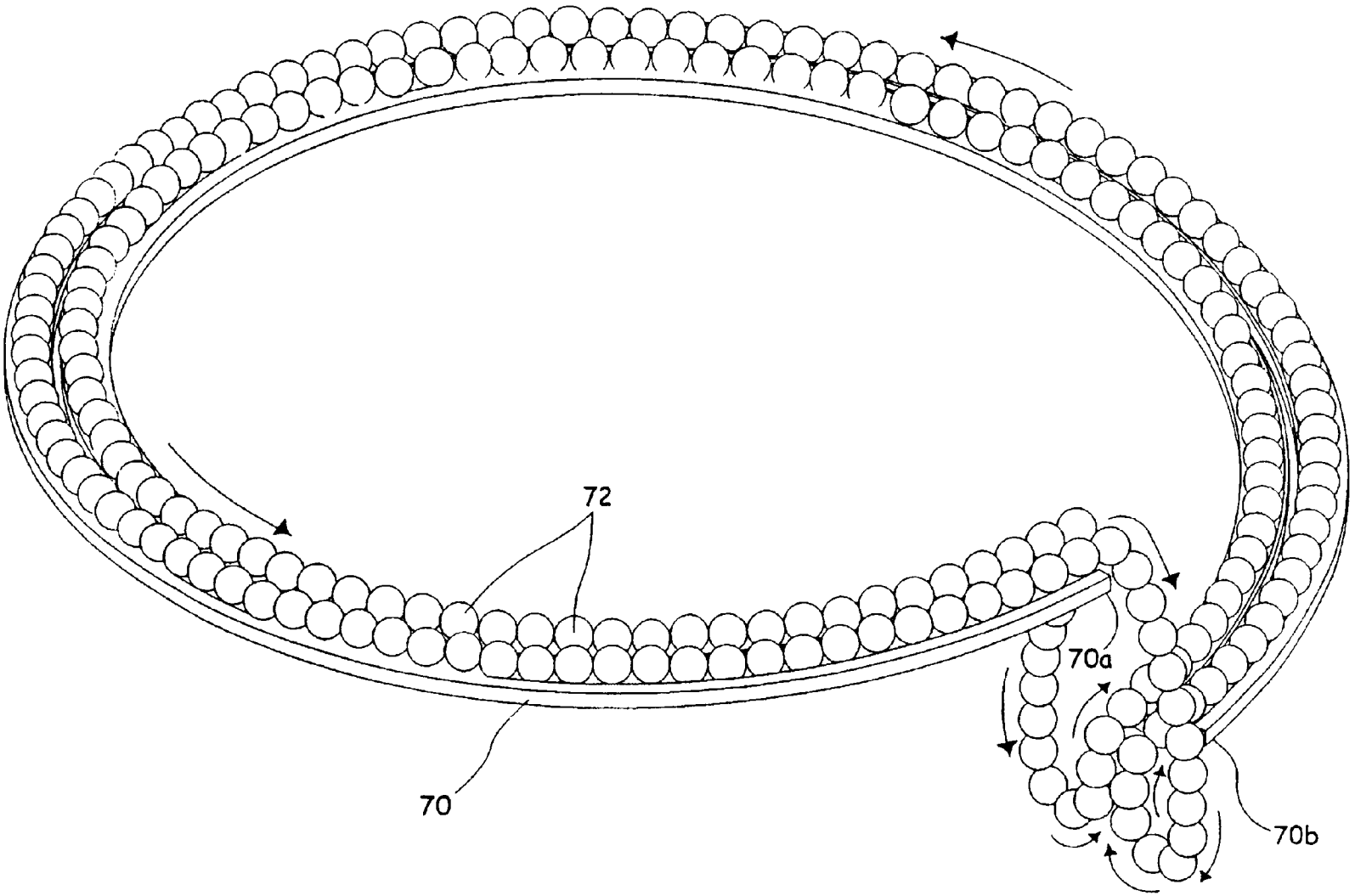
FIG. 5 is an enlarged perspective view showing the trajectory of the balls of the ball support member and further showing the track supporting the balls.

The balls 72 located between track 70 and horizontal band 24 allow the horizontal band 24 to remain rotatably motionless while the rotor member turns. As horizontal band 24 is lifted and as the rotor member turns, the balls are gradually displaced through a rolling and sliding engagement along track 70, and eventually reach the top of their trajectory at the leading end 70*a* of track 70 (FIG. 5), where they enter the channels 80, 82 in re-circulating unit 76 to be dispensed thereby at the bottom part of their trajectory, at the trailing end 70*b* of track 70 (FIG. 5). FIG. 5 shows with arrows the trajectory of balls 72 while the column 32 is being extracted. It is understood that balls 72 would circulate in the opposite direction while column 32 is being retracted.

The leaf springs 68 allow to more evenly distribute the load all around inner and outer drums 48, 50, and thus to more stably support of the load lifted or supported by push actuator 10. Consequently, push actuator 10 is structurally locally less stressed due to this more even distribution of the load. This is very important, since very heavy loads of several tons can be lifted and maintained at a set raised position by push actuator 10.

The rolling engagement of the vertical band magazine 34 on casing 38 is useful, since the vertical band magazine 34 will rotate about the push actuator central vertical axis to compensate for the greater diameter of the stored vertical band 30 relative to the column 32 being formed. Indeed, only a fraction of a turn of the stored vertical band is required to form a complete turn of the column 32, and thus the vertical band casing 34 will always rotate in the opposite direction of the rotor member 44, 46, 48, 50. Since the stacked portion of horizontal band 24 has a diameter which is equal to that of the column 32 being formed, no such compensation is required, and thus horizontal band 24 can be simply stored into the stationary casing 18.

The use of the balls 72 mounted on track 70 instead of the prior art rollers has the following advantages:

a) the production price is significantly lower, since rollers capable of supporting the loads that are lifted by a push actuator are very expensive, whereas the ball support member is a rather simple device;

b) the balls occupy much less space than the rollers did, and thus a diametrally smaller and more compact push actuator can be made; and c) the ball supporting track 70 can be mounted on the leaf springs 68, whereas the rollers could not, thus preventing the even distribution of the load as with the push actuator of the present invention (which results in enhanced load capacities for the present push actuator, ceteris paribus).

Any modification to the present invention, which does not deviate from the scope thereof, is considered to be included therein, as will become obvious to the person skilled in the art in the light of the appended claims.

For example, it is envisioned that the ball support member including a track engaged by a number of balls, be replaced by another continuous support member. A continuous support member is defined in the present invention as comprising a continuous track or channel, which will be allowed to support a portion of the horizontal band in a continuous fashion for a determined length. For example, the following continuous support members are also envisioned, although any other suitable continuous support member may also be used:

a) using cylindrical rollers supported on a track, instead of balls, including a roller re-circulation unit;

b) using rollers as per (a) above, wherein the rollers are serially linked by a chain and wherein the re-circulating unit could take the form of a geared wheel;

c) using a hydraulic or pneumatic pressure cushion formed in a closed track forming a closed loop to allow the fluid to re-circulate between the upper and lower ends of the helical supporting portion of the track; or d) using a super-conductor based magnetic levitation system.

In all of the above-mentioned cases, including the ball-support system as described in the present invention, the continuous support member is substantially frictionless, to allow the push actuator to be loaded with several tons without the friction forces hindering its operation.

We claim:

1. A telescopic tube comprising:

a first annular band wound in helical form about a central axis with its turns transversely normal to said central axis and capable of taking a retracted stacked position with its turns resting flat against one another, and an extended position with its turns spaced from one another in the direction of said central axis;

a second band wound on itself, with its turns transversely parallel to said central axis and capable of taking a retracted, spiral position with its turns nested within one another and an extended position with its turns forming a helix around said central axis and generally equally radially spaced therefrom to form a tube, said first and second bands, when in retracted position, being in respective locations so as to clear each other;

a frame having a base resting on the ground and a rotor rotatably carried by said base;

a continuous frictionless support member carried by said rotor and forming at least a portion of a helix for supporting part of said first band, and for successively spacing the turns of said first band;

a power device, to cause relative rotation of said first band and of said rotor about said central axis, said continuous frictionless support member allowing the axially oriented load of said push actuator to be transmitted from said first band to said rotor while allowing a substantially frictionless relative rotation of said first band and said rotor; and a guiding member to insert the turns of the second band between the spaced turns of the first band, with the edges of the turns of the second band bearing against the turns of the first band, the second band thus forming a spacer for the turns of the first band.

2. A telescopic tube as defined in claim 1, wherein said continuous frictionless support member includes a number of balls carried on a track carried by said rotor and forming at least a portion of a helix for supporting part of said first band, and for successively spacing the turns of said first band.

3. A telescopic tube as defined in claim 1, wherein said track has a first and a second ends, said continuous frictionless support member further comprising a ball re-circulation unit including at least one channel linking said track first and second ends for allowing said balls to engage said channel and consequently to circulate between said track first and second ends.

4. A push actuator having opposite first and second ends and an intermediate portion between said first and second ends, said push actuator further defining a central axis extending between said first and second ends and comprising:

a fixed base portion at said first end;

a rotor member rotatably carried by said base portion and rotatable about said central axis;

a power device, for selectively rotating said rotor member relative to said base portion;

a load-bearing member at said second end, movable relative to said first end, between a retracted position in which said load-bearing member is adjacent to said first end, and an extracted position in which said load-bearing member is distally located relative to said first end;

a first flat band being perpendicular to said central axis, being wound according to a helical pattern about said central axis, and having a first end portion adjacent said push actuator first end and a second end portion attached to said load-bearing member;

a second flat band being parallel to said central axis, being wound according to a helical pattern about said central axis, and having a first end portion adjacent said push actuator first end and a second end portion attached to said load-bearing member;

a continuous frictionless support member with at least a portion thereof being wound in a helical pattern about said central axis, with part of said first helical band engaging said continuous frictionless support member allowing substantially frictionless rotation of said rotor member relative to said first band; and a guiding member at said push actuator intermediate portion and carried by said rotor member, for guiding said second band so as to place each turn of each one of said first and second bands between two successive turns of the other one of said first and second bands between said intermediate portion and said second end when said rotor member is rotated in a first direction around said central axis, thus forming a telescopic column composed of the interconnected first and second bands with the edges of the turns of the second band bearing against the turns of the first band, and with said first and said second bands each being independently stackable between said intermediate portion and said first end.

5. A push actuator as defined in claim 4, wherein said continuous frictionless support member forms a closed loop around said central axis and includes:

a track carried by said rotor member, wound in a helical pattern and having a first and a second ends;

a re-circulating unit including at least one inner channel linking said track first and second ends; and a support medium capable of circulating along said track and through said re-circulating unit channel between said track first and second ends, with part of said first helical band engaging said continuous frictionless support member by bearing against said support medium for allowing substantially frictionless rotation of said rotor member relative to said first band.

6. A push actuator as defined in claim 5, wherein said continuous frictionless support member is a ball support member and said support medium is a number of balls engaging said track, with at least part of said first helical band engaging said balls for allowing substantially frictionless rotation of said rotor member relative to said first band.

7. A push actuator as defined in claim 6, wherein the portion of said first band which is located between said first end and said intermediate portion of said push actuator is stacked in a helical pattern, and wherein the portion of said second band which is located between said first end and said intermediate portion of said push actuator is stacked in a spiral pattern.

8. A push actuator as defined in claim 7, wherein said portion of said second band which is stacked in a spiral pattern is stored in a second band magazine which is rotatably carried by either one of said base portion and said rotor member.

9. A push actuator as defined in claim 6, wherein said track of said ball support member forms n complete helical turns, with n being a positive integer.

10. A push actuator as defined in claim 9, wherein said track of said ball support member forms a single complete helical turn.

11. A push actuator as defined in claim 5, wherein said push actuator base portion includes a ground-bearing structure supporting a casing through the instrumentality of a universal joint allowing pivotal displacement of said casing relative to said ground-bearing structure, with said rotor member being rotatably carried by said casing.

12. A push actuator as defined in claim 5, wherein said push actuator is destined to be used with its central axis being vertically aligned and with said first end being located under said second end, said load-bearing member being a platform member including a top platform and a lower saucer linked to each other by means of a universal joint for allowing pivotal displacement of said top platform relative to said lower saucer, with said second ends of said first and second bands being attached to said saucer.

13. A push actuator as defined in claim 5, wherein said push actuator is destined to be used with its central axis being vertically aligned and with said first end being located under said second end, said track being supported by said rotor by means of a spring member fixedly carried by said rotor.

14. A push actuator as defined in claim 13, wherein said spring member is a leaf spring formed in a helical pattern and continuously supporting said track.

15. A push actuator as defined in claim 6, wherein said ball support track comprises two helical ball channels wherein two adjacent rows of balls are provided.

16. A push actuator having a vertical central axis, comprising:

a fixed base;

a selectively rotatable rotor carried by said base;

a power device for selectively rotating said rotor about said central axis;

a horizontal helical band having a lower portion stacked in a helical pattern and a helical upper portion;

a vertical band, having a lower portion stacked in a spiral pattern separately from said horizontal band, and an upper helical portion engaged by the upper portion of said horizontal band to form a vertical telescopic column;

a helical ball support track member carried by said rotor and including a helical track along which a number of balls can roll and slide, said track having an upper and a lower end, said horizontal band resting on said balls to allow rotation of the rotor member while the horizontal band remains rotatably stationary;

a ball re-circulation unit linking said track upper and lower ends and including ball channels engageable by said balls to allow said balls to circulate between said track upper and lower ends; and a guiding member mounted to said rotor;

wherein upon rotation of said rotor, said vertical column is formed with the upper portions of said horizontal and vertical bands, by said horizontal band being lifted and its turns being spaced through its engagement on the rotating helical ball support track member, and by each turn of said vertical band being guided by guiding member to be inserted between two vertically successive turns of said horizontal band, with the edges of said vertical band bearing against said horizontal band.

* * * * *